United States Patent [19]

Vaarala

[11] 4,210,228

[45] Jul. 1, 1980

[54] CONTROL METHOD

[76] Inventor: Harri Vaarala, 33720 Tampere 72, Finland

[21] Appl. No.: 915,999

[22] Filed: Jun. 16, 1978

[30] Foreign Application Priority Data

Jun. 28, 1977 [FI] Finland ..... 772005

[51] Int. Cl.[2] ..... B66B 5/16

[52] U.S. Cl. ..... 187/73; 91/1; 91/447; 92/5 R; 371/14

[58] Field of Search ..... 187/73, 17, 27, 28, 187/20; 188/1 A, 65.1, 65.3; 235/303.3, 307, 303; 91/1, 447; 92/5 R

[56] References Cited

U.S. PATENT DOCUMENTS

| | | | |
|---|---|---|---|
| 1,727,432 | 9/1929 | Hymans | 187/73 |
| 1,738,215 | 12/1929 | Thurston et al. | 187/73 |
| 3,464,319 | 9/1969 | Sherman et al. | 91/1 |
| 3,810,119 | 5/1974 | Ziene et al. | 235/307 |
| 3,813,990 | 6/1974 | Coppola et al. | 91/1 |
| 3,890,493 | 6/1975 | Burtness et al. | 235/303.3 |

*Primary Examiner*—Robert R. Song
*Attorney, Agent, or Firm*—Miller & Prestia

[57] ABSTRACT

A method of temporarily maintaining the position of a hydraulically, pneumatically or electrically driven drive apparatus by sensing the movement of the drive apparatus and then supporting the drive apparatus by the components to be controlled.

7 Claims, 4 Drawing Figures

CONTROL METHOD

The present invention relates to a method of controlling components maintaining the position of a hydraulically, pneumatically or electrically driven drive apparatus. More specifically, the invention concerns a method of controlling the components holding the position of a loaded drive apparatus, such as the piston of a hydraulic press or a lift, the components including hydraulic piston sealings, safety valves or lift brakes. In view of safety, the drive apparatus must stay in its position even if one of the components contributing to the stoppage of the drive apparatus is damaged during the work cycle.

The principle in the prior art methods is the use of drive means which independently of each other maintain the drive apparatus in position in order to ensure its standstill. This reduces the likelihood of accidents since it is unlikely that both drive means ensuring the standstill would go out of order simultaneously. However, there are many drive apparatus, e.g. hydraulic presses and lifts, in which even a slightest chance of an accident is not acceptable.

The object of the invention is to provide such a control method of components holding the position of a loaded drive apparatus, by which it is possible to practically completely prevent the accidents caused by damage of the components to be controlled.

This object is accomplished according to the invention in such a way that the loaded drive apparatus is temporarily supported by the components to be controlled and, during this time, the condition of components is indicated as based on the change of the position of drive apparatus.

Supporting a loaded drive apparatus temporarily on the components to be controlled is in practice effected so that the means, which actively controls the drive apparatus or its component to be controlled, and the rest of the control system functions with the time difference during which time the drive apparatus is supported by the components to be controlled. An actively controlled component refers in this context to a control means controlled by outside impulse. Such control means include e.g. electrically or manually operated direction valves.

If the condition of the components such as sealings, pipework parts and valves used for the standstill of a drive apparatus is controlled by the method of the invention, faults can be detected in the early stage and corrected before the fault has expanded so that it is hard to correct or it has caused other faults or accident. Another advantage of the method is its simplicity and low costs.

Figure 1A:
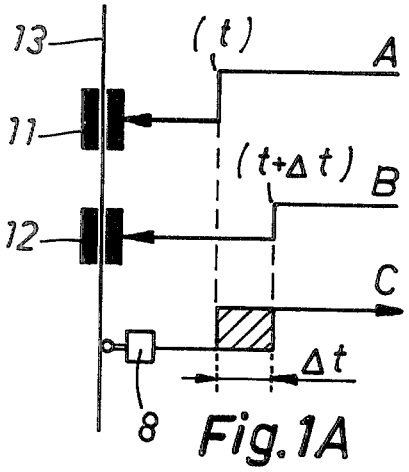
Figure 1B:
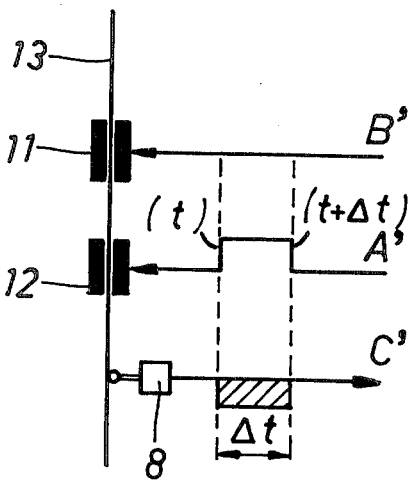

The following is a detailed description of a few embodiments of the invention with reference made to the accompanying drawings, in which:

FIGS. 1A and 1B present schematically the adaptation of the method according to the invention to the control of lift brakes.

Figure 2:
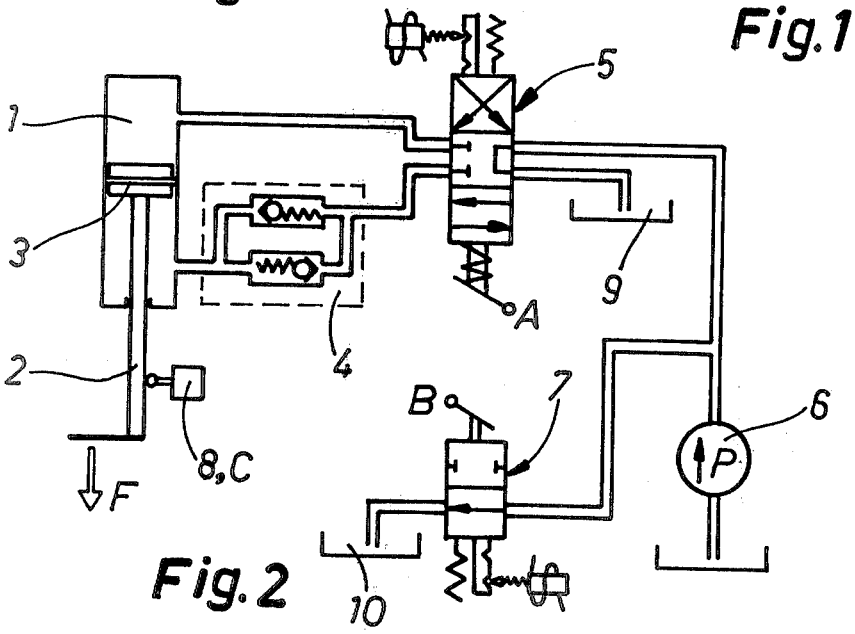
Figure 3:
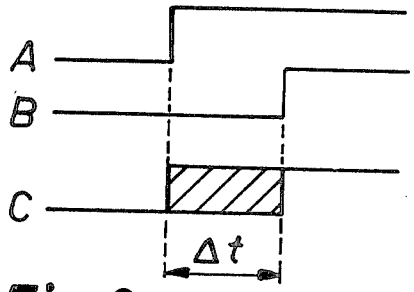

FIG. 2 presents the adaptation of the method according to the invention to the control of components holding a hydraulic apparatus standstill, and FIG. 3 shows a diagram of the control impulses employed in the method.

In FIGS. 1A and 1B the brake cable 13 of a lift is held in position by means of two separate brakes 11 and 12. Opening and closing of both brakes is controlled separately. Supposing that the initial situation in FIG. 1A is such that the stationary lift has received control command to move. A represents the control command received by brake 11 and B represents the control command received by brake 12 and C represents a signal provided by detector 8 sensing the movement of brake cable 13 (or some other part of the lift). At the moment (t), when the lift has received the move command, brake 11 opens. At this point, the lift is supported only by brake 12 either by its own weight or loaded by a lift moving motor. After a little time difference $\Delta t$, brake 12 is also opened. Prior to that, the condition of brake 12 is tested during the time difference $\Delta t$, when the lift is supported only by brake 12. Now, if signal C provided by detector 8 is already received within a time interval $\Delta t$ (shaded area in signal C), brake 12 is not in proper condition. The fault an alarm signal C can be used to give out alarm or to close brake 11 in order to prevent the movement and use of the lift until brake 12 is repaired.

FIG. 1B similarly presents the check on the condition of brake 11, when the lift has just stopped. Thus, both brakes 11 and 12 are closed. After the stopping of the lift has been detected, control A' is given to brake 12 at the moment (t) to open brake 12. Brake 12 is kept open for the period $\Delta t$, the lift thus being supported only by brake 11. If detector 8 gives out a signal C' within time interval $\Delta t$, brake 11 is faulty.

In the following the method of the invention is described as adapted to the control of components holding a hydraulic drive apparatus standstill. The drive apparatus comprises a piston 2 movable in a hydraulic cylinder 1, the piston being loaded by a force F. The movements of piston 2 in cylinder 1 are controlled by a direction valve 5 and a valve 7. The standstill of piston 2 despite the effect of the loading force F, in case valve 5 is damaged, has been secured by a valve 4. The spring force of a spring-loaded return valve 4 has been regulated so that the loading F cannot alone open the valve 4. Thus, piston 2 won't move in the direction of force F until the pressure of pump 6 is exerted above the piston. In addition to valve 4, the components to be controlled also include sealings 3 of piston 2 and the hydraulic pipeworks associated with cylinder 1. The displacement of piston 2 is indicated by detector 8. Piston 2 is operated by a hydraulic pump 6 and the direction of movement is controlled by a direction valve 5. In FIG. 3, part A of the diagramrepresents the control received by valve 5, B represents the control received by valve 7, and C represents the signal provided by detector 8. The diagram is exactly identical to that in FIG. 1A. In the example of FIG. 2, the method proceeds as follows: when piston 2 is set in motion in the loading direction, valve 5 is regulated for the time interval $\Delta t$ prior to valve 7. During the time $\Delta t$, the pump 6 is connected via valve 7 for idle running in a tank 10 so it does not exert pressure on the upper part of cylinder 1. Thus, the pressure produced by loading F alone on the lower part of cylinder 1 is smaller than the pressure by which the valve 4 can be kept closed. If valve 4 and sealing 3 are undamaged, the piston 2 stays standstill also for the time interval $\Delta t$. On the other hand, if detector 8 provides a signal indicating movement of the piston 2 already during the time interval $\Delta t$ (shaded area in FIG. 3), one of the components 3, 4 to be controlled has faulted. If such a failure were added to by damage of valve 5, it would in many cases endanger the operator or also damage other components. According to the invention, this failure can, however, be indicated immediately by means of control B and signal C given after the time delay Δt and fixed before the failures appear simultaneously together. By closing the valve 7 after the time interval Δt, the desired movement of piston 2 in the loading direction F is obtained.

It is to be noted that, in addition to the above two examples, the method of the invention can be adapted to the control of components used for holding a great variety of drive devices within the scope of the following claims.

What we claim is:

1. In a control system for a load carrying output member driven by a command signal, the combination comprising;

(a) a first means having an engaged position to prevent movement of said output member, said first means disengaging said output member in response to said command signal, (b) second means having an engaged position to prevent movement of said output member, said second means disengaging said output member in response to said command signal after a predetermined time delay, and (c) detecting means for sensing and signalling the movement of output member during said time delay.

2. The control system according to claim 1 wherein said first means engages said output member to prevent movement thereof in response to a signal from said detecting means.

3. The control system according to claim 1 wherein said load carrying output member is a lift and said first and second means being brakes.

4. The control system according to claim 3 wherein each of said brakes engage a cable operating to drive said lift, each of said brakes disengaging said cable successively with a time delay in response to a command signal so as to determine the condition of the brake last engaging said cable.

5. The control system according to claim 4 wherein upon stoppage of said lift only one of said brakes is opened with a time delay and said detecting means senses and signals movement of cable so as to determine the condition of the closed brake.

6. The control system according to claim 1 wherein said output member is a piston cylinder member of a hydraulic drive apparatus, said first means being a direction valve and said second means being a return valve, and including piston sealing means on the piston for supporting a load on the piston, whereby the movement of the piston is sensed to determine the condition of said return valve and said piston sealing means.

7. The control system of claim 6 wherein said direction valve is regulated for a time interval prior to said return valve.

* * * * *